US005244024A

United States Patent [19]

Oosthuizen

[11] Patent Number: 5,244,024

[45] Date of Patent: Sep. 14, 1993

[54] WALLET

[76] Inventor: Andre D. F. Oosthuizen, 38 Sunny Birches, Paradise Valley Pinetown, Natal, South Africa

[21] Appl. No.: 775,022

[22] Filed: Oct. 11, 1991

[30] Foreign Application Priority Data

Oct. 11, 1990 [ZA] South Africa ..... 90/8113

[51] Int. Cl.[5] ..... A45C 1/06

[52] U.S. Cl. ..... 150/139; 150/136

[58] Field of Search ..... 150/130, 139, 150, 151; 383/41

[56] References Cited

U.S. PATENT DOCUMENTS

| | | | |
|---|---|---|---|
| 840,661 | 1/1907 | Rood | 150/139 X |
| 1,807,655 | 6/1931 | Eriksson | 383/41 X |
| 1,936,358 | 11/1933 | Herold | 150/151 X |
| 2,077,536 | 4/1937 | Taggart | 150/136 X |
| 2,154,226 | 4/1939 | Stember et al. | 150/139 X |
| 2,422,432 | 6/1947 | Meller | 150/139 X |
| 2,446,009 | 7/1948 | Hyman | 150/139 |
| 2,455,527 | 12/1948 | Seamon | 150/136 |
| 2,477,840 | 8/1949 | Vasilas | 150/136 |
| 2,573,063 | 10/1951 | Renz | 150/136 |
| 2,581,029 | 1/1952 | Knee | 150/136 |
| 2,854,051 | 9/1958 | Lowe | 150/136 |
| 3,111,151 | 11/1963 | Stember | 150/136 |
| 3,496,979 | 2/1970 | Bosca | 150/136 |

FOREIGN PATENT DOCUMENTS

| | | | |
|---|---|---|---|
| 234386 | 5/1925 | United Kingdom | 150/136 |

*Primary Examiner*—Sue A. Weaver

*Attorney, Agent, or Firm*—Young & Thompson

[57] ABSTRACT

A wallet has a pouch for notes provided with a slot which communicates with a pocket hinged to the pouch so that a mixture of notes and coins may be hurriedly put into the pouch. The coins fall through the slot into the pocket which is then folded into the wallet and the coins can be removed at a convenient opportunity.

1 Claim, 1 Drawing Sheet

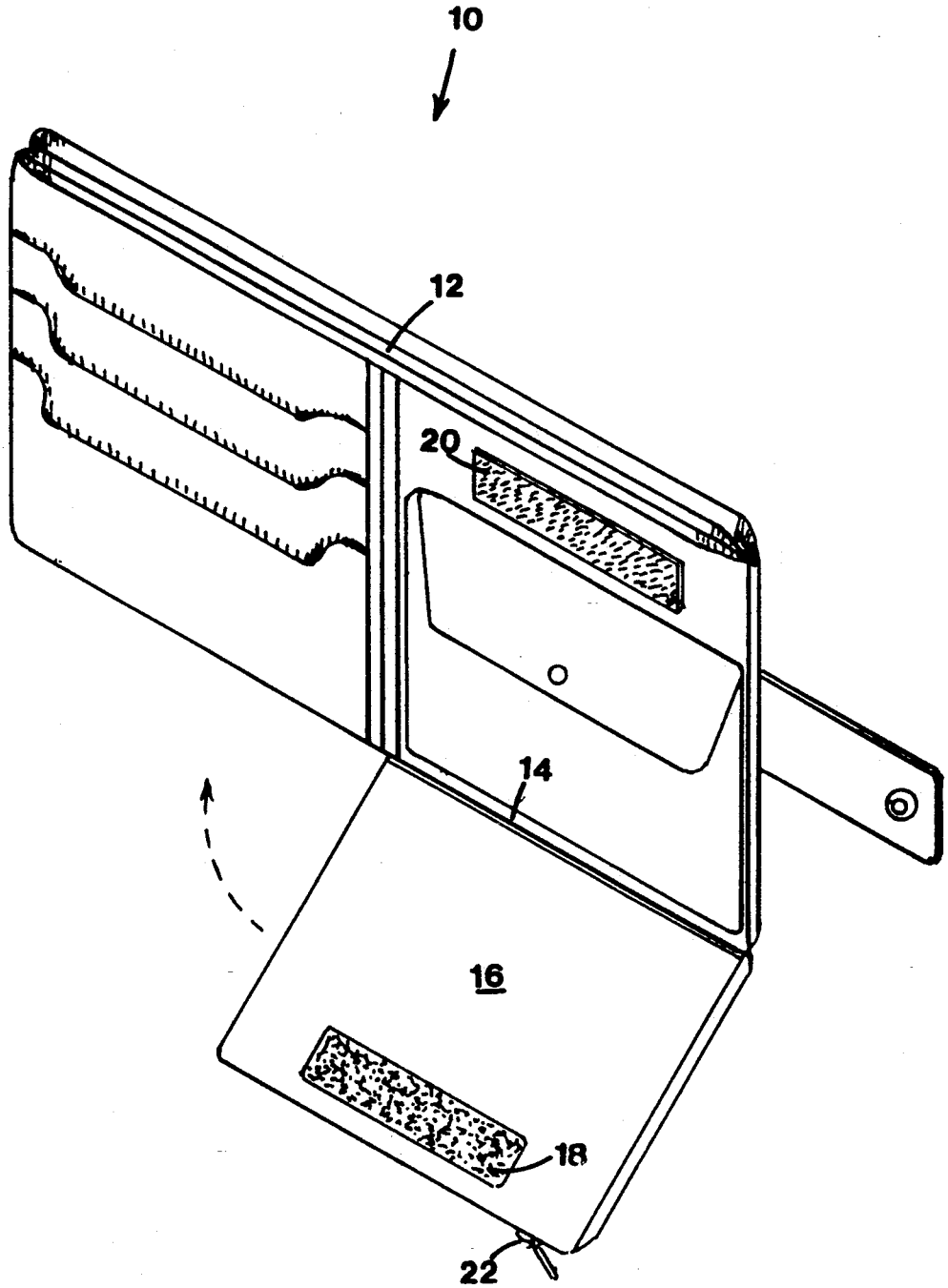
10
12
20
14
16
18
22

WALLET

FIELD OF THE INVENTION

This invention relates to a wallet or purse.

BACKGROUND OF THE INVENTION

Almost any purchase involves small change and one often is handed a mixture of notes, coins and receipts. This is difficult to handle because of the desire to place the notes in the particular pouch of a wallet or purse, and the coins in a pocket; and it becomes more difficult when the other hand is carrying a parcel.

It is an object of the present invention to alleviate this difficult and to produce a new wallet or purse (both terms hereafter being referred to as a wallet.

SUMMARY OF THE INVENTION

According to the invention, a wallet includes a pouch for notes which communicates with a pocket movable from a first position in which it depends downwardly from the pouch and a second position in which it folds into the area defined by the wallet.

Thus, a mixture of notes and coins may be inserted into the pouch whereupon the coins will fall through the communication orifice or gap into the pocket, which is then folded into the wallet. The coins may be removed at a convenient time.

The pocket may have a button, press stud, strip of VELCRO (registered trade mark) or other fastening means for retaining it in its folded position.

BRIEF DESCRIPTION OF THE DRAWING

An embodiment of the invention is described below with reference to the accompanying drawing which is an isometric view of a wallet incorporating the present invention.

DETAILED DESCRIPTION OF THE INVENTION

In the drawing, a wallet 10 includes an internal slot (not visible) along the line 14. A downwardly-depending pocket 16 is provided which communicates through the slot with the pouch 12. The pocket 16 has a VELCRO strip 18 which, when folded into the wallet engages with a corresponding strip 20. The pocket 16 may include a zip 22 to provide convenient means to remove coins.

I claim:

1. A combination wallet and purse comprising: a pouch which is divided by a fold into a first upper compartment for notes, and a second lower compartment for coins insertable through said first compartment and said fold when the pouch is unfolded and which are retained therein when said pouch is refolded; said second compartment having its own opening and means for closing and opening said opening for withdrawal of coins and also having securing means for securing it to the first compartment in its folded position.

* * * * *